US007095600B2

(12) United States Patent
Zaretsky et al.

(10) Patent No.: US 7,095,600 B2
(45) Date of Patent: Aug. 22, 2006

(54) ELECTROSTATIC CHARGE NEUTRALIZATION USING GROOVED ROLLER SURFACE PATTERNS

(75) Inventors: Mark C. Zaretsky, Rochester, NY (US); Paul A. Corbelli, Leroy, NY (US); Brooks J. Schneider, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 320 days.

(21) Appl. No.: 10/283,458

(22) Filed: Oct. 30, 2002

(65) Prior Publication Data

US 2004/0085705 A1 May 6, 2004

(51) Int. Cl.
*H05F 3/00* (2006.01)
*H05C 1/00* (2006.01)

(52) U.S. Cl. ..... 361/212; 361/214; 427/472

(58) Field of Classification Search ..... 361/212, 361/214, 219, 220, 221, 222; 427/458, 472; 399/161

See application file for complete search history.

(56) References Cited

U.S. PATENT DOCUMENTS 3,405,855 A 10/1968 Daly et al.
3,472,676 A * 10/1969 Cassiers et al. ..... 430/118
3,730,753 A 5/1973 Kerr
4,402,035 A * 8/1983 Kisler ..... 361/213
4,426,757 A 1/1984 Hourticolon et al.
4,517,143 A 5/1985 Kisler
5,387,966 A * 2/1995 Karashima ..... 399/286
5,431,321 A 7/1995 Link et al.
5,753,348 A * 5/1998 Hatakeyama et al. .... 428/195.1
5,805,407 A 9/1998 Takano et al.
6,177,141 B1 1/2001 Billow et al.
6,572,516 B1 * 6/2003 Clarke et al. ..... 492/30

OTHER PUBLICATIONS

Knox & Sweeney, IECP J. V. 10, 1971.

* cited by examiner

*Primary Examiner*—Brian Sircus
*Assistant Examiner*—Danny Nguyen
(74) *Attorney, Agent, or Firm*—Paul A. Leipold; Mark G. Bocchetti

(57) ABSTRACT

A method for coating a liquid composition from an applicator to a first surface of a moving web having opposite first and second surfaces, the web being conveyed along a path through a coating apparatus, the coating apparatus including a charge neutralization station for neutralizing stray charges on the web, the charge neutralization station including a backing roller and means for depositing a charge on the web includes the steps of: wrapping the web in a partial wrap around the backing roller, the backing roller being provided with a conductive, relieved surface, the relieved surface having a pattern of circumferential grooves that provides venting of entrained air, the pattern having a geometry and depth such that any charge left on the web does not disturb the coating applied by the coating apparatus; providing a source of electrostatic charge at the charge neutralization station to neutralize any charge on the web; and transporting the charge neutralized web to a coating station, where a liquid composition is applied to the first surface, whereby the coating of liquid composition is not disturbed by stray electrostatic charges.

10 Claims, 3 Drawing Sheets

ELECTROSTATIC CHARGE NEUTRALIZATION USING GROOVED ROLLER SURFACE PATTERNS

FIELD OF THE INVENTION

The present invention relates to control of surface charge on a moving web, and more particularly to the use of surface patterns on a backing roller employed in a charge neutralization apparatus, prior to coating a web with any of various kinds of liquid compositions.

BACKGROUND OF THE INVENTION

It is well known that random electrostatic surface charges on a moving web can give rise to coating non-uniformities for many types of coating systems, such as slide hopper bead or curtain coating. For example, U.S. Pat. No. 3,730,753, describes a coating non-uniformity introduced by random surface charges created on the web by a corona treatment process used to improve the adhesion of photographic emulsion to polyethylene-coated paper. Furthermore, U.S. Pat. No. 3,730,753 also describes an electrostatic charge neutralization system that can be used to remove the random surface charges, thereby eliminating the coating non-uniformity. Other examples of systems used to eliminate surface charge on a moving web prior to a liquid coating process may be found in U.S. Pat. Nos. 4,517,143 and 5,805,407. For each one of the charge neutralization systems described in these three patents, there is a set of one or more electrodes, connected to a high voltage power supply, used to deposit charge on a moving web while the web is wrapped around a backing roller which is typically connected to electrical ground. It should be noted that the efficiency and uniformity of the charge deposition process is highly dependent upon the web-to-roller capacitance. Variations in this capacitance, as caused by either intermittent air pockets between the web and backing roller, or by relief patterns in the surface of the backing roller, will create non-uniformities in the charge deposition process, giving rise to a non-uniform charge pattern on the web that can cause non-uniform coatings. No description is given in any of these patents regarding the relief patterns, if any, of the backing roller.

The moving web carries with it a boundary layer of air on the front side (the side to be coated) and the back side (the side facing the backing roller). For every conveyance system there exists a speed at which conveyance is limited by back surface air entrainment between the web and the conveying roller. If the surface of the backing roller is smooth and the moving web is conveyed around the roller, then an air film will arise between the web and roller, creating an air bearing between the two surfaces. This air film thickness (h) is a function of several parameters: 1) coating roller radius (R), 2) dynamic air viscosity (μ), 3) web speed ($U_w$), 4) roller speed ($U_R$), and 5) web tension per unit width (T) and is given by the following equation:

$$h = 0.643R\left(\frac{6\mu(U_w + U_R)}{T}\right)^{2/3} \qquad \text{Equation 1}$$

[Knox & Sweeney, IECP J., V. 10, 1971].

For a given air viscosity and web tension, the air film thickness will increase with increasing web/roller speed and/or roller diameter. This increase in air film thickness results in decreased contact between the web and roller, with a concomitant loss in traction. If the speed is increased to the point that the air film thickness is of the same order, or larger than, the roughness of either the smooth roller surface or the surface of the web facing the roller, then traction will be lost completely, resulting in slippage of the roller against the web. This loss of traction can result in problems such as scratches or variations in tension and speed. In addition to loss of traction, the entrained air film thickness between the web and roller will result in a change in the web-to-roller capacitance, causing a non-uniform charge deposition and possibly leading to a non-uniform coating, as described previously.

It is known to provide means to remove or exhaust the boundary layers of air being carried on the back surface of a web and the surface of a roller when the two come into contact, increasing thereby the tractional contact of the web with the roller. Such means may include, for example, a pressure-loaded nip roller urged toward the conveying roller, the web passing therebetween. However, use of a nip roller may not be particularly desirable for several reasons including: 1) additional mechanical complexity to the apparatus that increases cost and reduces reliability, 2) increased potential for creasing of the web, particularly with thin webs, 3) possible marring of the surface of the web to be coated by the face-side nip roller, and 4) increased possibility of creating surface charges on either or both of the web surfaces due to the higher contact area produced by a nip roller, resulting in coating non-uniformities.

Such means may also include a relief pattern formed in the surface of the conveying roller into which the back-side boundary layer air may be exhausted from the web and escape. See U.S. Pat. No. 3,405,855 issued Oct. 15, 1968 to Daly et al., for example. In this patent, Daly et al. teach the use of a roller having circumferential venting grooves and supporting land areas to vent air carried by the underside of the traveling web, but there is no suggestion by Daly et al. that a grooved roller could be used at a charge neutralization station. Another example is provided by U.S. Pat. No. 4,426,757 issued Jan. 24, 1984 to Hourticolon, et al. In this patent, Hourticolon, et al. teach the manufacture and use of a roller having a surface relief consisting of a "finely branched network of compression chambers", allowing the entrained air to be compressed into pockets rather than reducing the web traction. Both of these patents deal with purely conveyance roller issues and neither patent addresses the issue of web charge neutralization with such a roller surface pattern. It is not obvious that these roller surface patterns would perform well during a web charge neutralization process, because these relief patterns will create variations in the web-to-roller capacitance, causing charge non-uniformities that lead to coating non-uniformities.

U.S. Pat. No. 6,177,141 teaches the use of a relieved coating backing roller when using electrostatic assist to coat moving webs at high conveyance speeds. The use of a relief pattern that produces an electrostatic force variation at the coating point of less than a factor of about ten provides good traction at high speed and enables the use of electrostatic assist to provide high speed coatings while avoiding the gross failure of air entrainment at the coating point. However, it is not obvious that the use of a similar relieved backing roller would perform well if used in the charge neutralization process, because the non-uniformity in charge deposition associated with the use of such a relieved backing roller is not correlated with, nor can it be predicted by the electrostatic non-uniformity created by the same relieved backing roller when used as a coating backing roller.

It is known to provide a random pattern known as a mezzo pattern on a backing roller at a charge neutralization station. Such a pattern, known as a 50 mezzo coarse pattern, is shown in FIG. 1. This pattern is produced by chemically etching the surface of the roller, limiting the maximum practical depth achievable with this process. Typically, this maximum venting depth is in the range of 20 to 80 μm. Although the mezzo pattern does not produce objectionable patterns in a coated film, one problem encountered with this mezzo pattern is that at higher web conveyance speeds, effective contact with the web is lost.

There is a need therefore for an improved backing roller for use in a charge neutralization process that provides good conveyance and good charge uniformity at high speeds.

SUMMARY OF THE INVENTION

A method for coating a liquid composition from an applicator to a first surface of a moving web having opposite first and second surfaces, the web being conveyed along a path through a coating apparatus, the coating apparatus including a charge neutralization station for neutralizing stray charges on the web, the charge neutralization station including a backing roller and means for depositing a charge on the web includes the steps of: wrapping the web in a partial wrap around the backing roller, the backing roller being provided with a conductive, relieved surface, the relieved surface having a pattern of circumferential grooves that provides venting of entrained air, the pattern having a geometry and depth such that any charge left on the web does not disturb the coating applied by the coating apparatus; providing a source of electrostatic charge at the charge neutralization station to neutralize any charge on the web; and transporting the charge neutralized web to a coating station, where a liquid composition is applied to the first surface, whereby the coating of liquid composition is not disturbed by stray electrostatic charges.

ADVANTAGES

The present invention has the advantage that charge on a moving web can be effectively neutralized at higher web transport speeds without leaving residual charge patterns that result in non-uniformities in coatings subsequently applied to the web. As will be shown in this invention, use of a grooved backing roller with proper choice of groove pitch and depth can provide excellent traction while minimizing the charge non-uniformity so as to produce excellent coating quality. Additionally, the pattern is easier to manufacture and easier to clean than the prior art mezzo pattern.

DETAILED DESCRIPTION OF THE INVENTION

Figure 1:
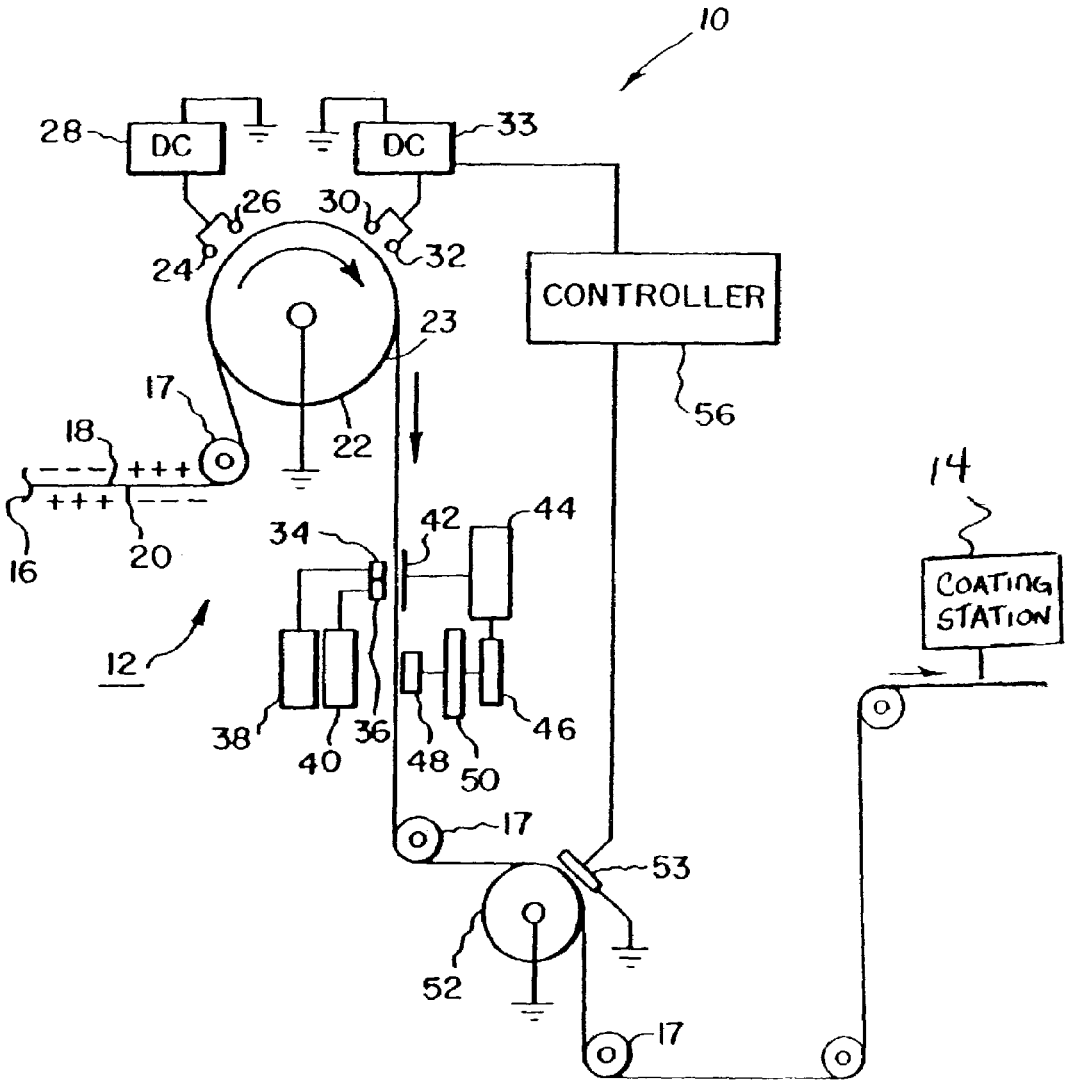
FIG. 1 is a schematic diagram of a charge neutralization station in a web coating apparatus useful with the present invention.

Referring to FIG. 1, a coating apparatus 10 for coating a liquid composition to a web in accordance with the invention includes a web charge neutralization section 12 and a coating station 14 for applying a coating to the web. The coating station 14 may comprise, for example, a bead or curtain coating station. Other known coating applicators, for example, an extrusion hopper or a slide-extrusion hopper, may also be readily adapted for use in accordance with the invention.

In a presently preferred embodiment, a continuous web 16 having first and second surfaces 18, 20, is supplied to section 12 from a conventional unwinding and conveyance apparatus (not shown) and may be conveyed conventionally through the apparatus on transport rollers 17. Web 16 may be formed of any substantially non-conductive material including, but not limited to, plastic film, paper, resin-coated paper, and synthetic paper. Examples of the material of the plastic film are polyolefins such as polyethylene and polypropylene; vinyl copolymers such as polyvinyl acetate, polyvinyl chloride, and polystyrene; polyamide such as 6,6-nylon and 6-nylon; polyesters such as polyethylene terephthalate, and polyethylene-2 and -6 naphthalate; polycarbonate; and cellulose acetates such as cellulose diacetate and cellulose triacetate. The web may carry one or more coats of subbing material on one or both surfaces. The resin employed for resin-coated paper is typically a polyolefin such as polyethylene.

Web 16 may have patches of electrostatic charges (illustrated by plusses (+) and minuses (−)) disposed randomly over one or both surfaces 18, 20. In Charge neutralization station 12, charges on the web are neutralized. Various methods and apparatus known in the art, including but not limited to those disclosed in the patents recited hereinabove, may be suitable for charge neutralization in station 12 in accordance with the invention.

In an embodiment presently preferred for both plastic and paper webs, station 12 operates as follows. Web 16 is partially wrapped and conveyed around a grounded, conductive backing roller 22 with web surface 20 in intimate contact with the conductive surface 23 of roller 22. Web surface 18 is exposed to negatively charged electrodes 24, 26 which "flood" a large amount of negative charges (such as electrons or negative ions) onto surface 18. Electrodes 24, 26 may be electrically connected to the negative terminal of an adjustable 0–20 kV, 0–15 mA source 28 of DC potential. Grounded roller 22 acts as a counter electrode for electrodes 24, 26.

As web 16 is advanced along roller 22, it moves beneath electrodes 30, 32 which may be electrically connected to the positive terminal of a DC potential source 33 similar to source 28. Electrodes 30, 32 deposit a large amount of positive charges (such as positively charged ions) onto web surface 18 which neutralize the negative charges previously imparted to this surface by electrodes 24, 26. Grounded roller 22 functions as a counter electrode for electrodes 30, 32.

Web 16 is further conveyed about a grounded roller 52 so that web surface 20 is in intimate contact with roller 52, the opposing web surface 18 being exposed to an induction probe 53 of a feedback control system comprising probe 53 and controller 56, which controller is responsive to the level of charge sensed by probe 53 and may be programmed to automatically adjust the level of charge applied by DC source 33 to electrodes 30, 32 to control the steady-state residual charge on surface 18 at any desired value. Controller 56 is programmed to provide a residual voltage at probe 53 preferably near or at zero.

The just-described electrostatic web treatment typically is sufficient to completely discharge all charges on surface 18 of the web and some of the charge on surface 20. However, some webs may retain some residual charge on surface 20, which may also be removed.

After leaving roller 22, web 16 may be conveyed past two fixed voltage or fixed DC current ionizers 34, 36, which are mounted near and facing surface 20 of web 16 on a free span of travel. The ionizers 34, 36 are mounted so that the central axis of each ionizer is oriented parallel to the web in the transverse direction of the web. Each ionizer is electrically connected to a separate DC high voltage power supply 38, 40. A conductive plate 42, which is electrically isolated from ground, is positioned opposite ionizers 34, 36 and facing surface 18 of web 16. Plate 42 can be of various shapes, designs, constructions, or materials, including both solid materials and screens, but plate 42 must incorporate at least a layer of conductive material to act as an equipotential surface to attract charge from ionizers 34, 36. A controllable bipolar high voltage source 44 is electrically coupled to plate 42 to deliver voltage to the plate over a wide range of positive and negative voltages (+/−5 kV). A feedback control system 46 may have a sensor or sensor array 48 responsive to the mean charge density residual on the web after treatment by the ionizers. Source 44 may be adjusted manually to adjust the voltage level on plate 42 so that the plate voltage increases in the same polarity as a direct function of the residual charge density on the web; preferably, such adjustment is controlled automatically by electronic controller 50 to minimize the steady-state residual free charge on the web, preferably near or at zero.

It is known in the coating art to relieve air pressure under a web being conveyed around a roller, caused by the web's back surface boundary air layer, by providing a patterned relief in the surface of the roller. Such patterning can be very effective in allowing boundary layer air to escape either laterally or, more commonly, longitudinally off the web.

As is known in the art, relief patterning may take any of several forms. For example, a roller surface may be formed in a random pattern (see U.S. Pat. No. 4,426,757) or may be wound with spaced-apart turnings of wire (see U.S. Pat. No. 5,431,321). Such random pattern may be etched, machined, abraded, or shot-blasted to provide surface relief, which relief may comprise a finely branched collection of chambers and troughs in the roller surface with adjacent plateau-like surfaces presenting a generally cylindrical land area for supporting the web, as taught by Hourticolon, et al. By plateau-like surface it is meant a surface whose topography is relatively flat as compared to the depth of the chambers and troughs.

Figure 2:
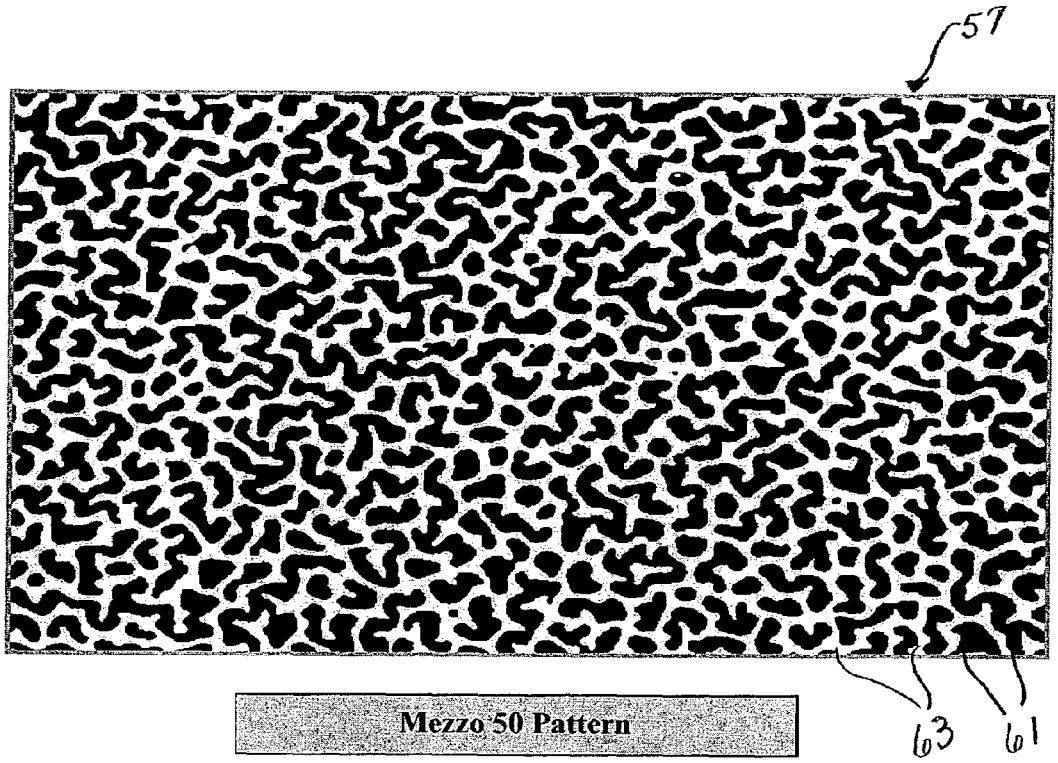
FIG. 2 (Prior Art)
FIG. 2 is a diagram showing a prior art mezzo pattern used on a backing roller in the charge neutralization station.

In particular, a mezzo pattern as shown in FIG. 2 has been employed on the surface of the backing roller 22 to provide improved traction between the web and the backing roller by allowing air to be compressed and vented. As shown in FIG. 2, the mezzo pattern consists of a collection of etched chambers and troughs 61 in the roller surface with adjacent plateau-like surfaces 63 presenting a generally cylindrical land area for supporting the web.

Figure 3:
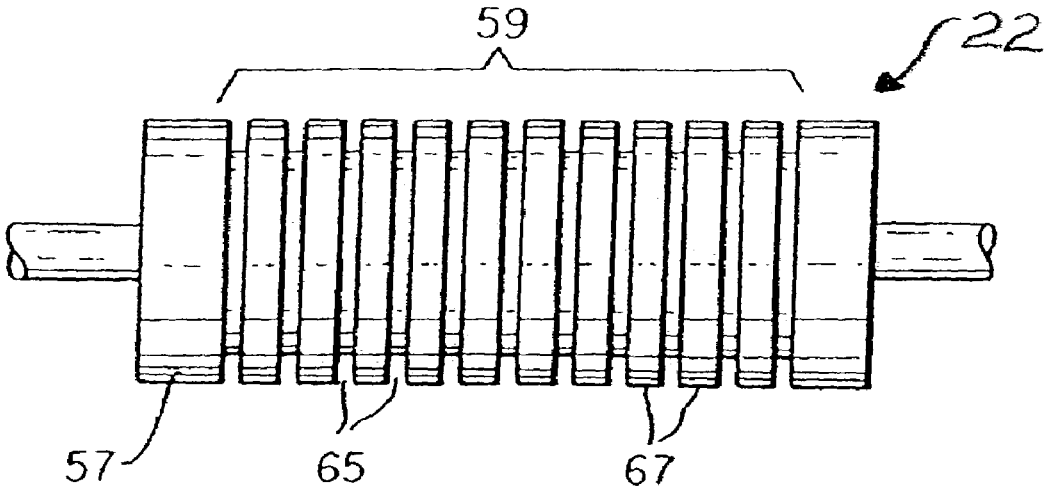
FIG. 3 is a front view of a grooved backing roller according to the present invention.

Referring to FIG. 3, according to the present invention, the backing roller 22 is provided with a pattern 59 comprising a plurality of circumferential grooves 65 and ridges 67 in the surface 57 of the roller 22. As used herein, the term circumferential includes continuous or interrupted spiral grooves. The ridges presenting a generally cylindrical closely axially spaced land area for supporting the web and permitting the web to bridge the grooves, the grooves being vented to ambient atmosphere at the oncoming and off-running sides of the area of web wrap of the roller. To insure that intimate contact is maintained between the web surface 20 and the surface of the backing roller 22, the width of pattern 59 is equal to or greater than the width of the liquid coating that is to be applied to the web surface 18 at coating station 14. The depth and spacing of the circumferential grooves are selected so that adequate venting between the web and backing roller is achieved at the desired coating speed and any remaining charge non-uniformities on the web do not result in lines in the coating.

EXAMPLE 1

Traction measurements were made on 3 rollers (A, B, C), each having a different venting pattern. The roller diameter was approximately 20 cm. Roller A had a 50 mezzo coarse venting pattern as shown in FIG. 2 with an effective venting depth of 40 μm, Roller B had a groove pitch of 1.6 gpmm, groove depth of 200 μm, and a groove width of 160 μm, Roller C had a groove pitch of 3.2 gpmm, groove depth of 140 μm, and a groove width of 60 μm. The web used was a polyester web having a thickness of 125 μm, conveyed under a tension of 1.3 N/cm. The table below summarizes the superior performance, as measured by coefficient of friction (COF), for Rollers B and C, where the larger COF corresponds with improved traction.

TABLE 1

| Roller | Groove Pitch (gpmm) | COF @ 2.5 m/s | COF @ 5 m/s |
|---|---|---|---|
| A | Mezzo | 0.09 | 0.03 |
| B | 1.6 | 0.22 | 0.19 |
| C | 3.2 | 0.22 | 0.20 |

EXAMPLE 2

A three-layer coating pack was formed of aqueous gelatin emulsions, the bottom layer containing carbon black to provide optical density. The top layer contained gelatin and a surfactant, exhibited a viscosity of 30 cP and had coating thickness of 18 μm. The middle layer contained gelatin, exhibited a viscosity of 16 cP, and had a coating thickness of 48 μm. The bottom layer contained gelatin and carbon black, exhibited a viscosity of 15 cP, and had a coating thickness of 18 μm. Bead coatings were made at 1.5 m/s onto a polyester web substrate subbed on both sides with a surface resistivity of about $10^{13}$ ohm per square at relative humidity of 50% and having a thickness of 100 μm. The space between the hopper lip and the outer surface of the web was 250 μm. Hopper suction was roughly 250 Pascals. The coating pack was coated using a coating backing roller having a groove pitch of 4 gpmm, groove depth of 45 μm, and a groove width of 200 μm. An electrostatic assist was obtained by controlling the potential of the backing roller to either 0 or 900 volts.

Prior to coating, the charge on the web was neutralized using a web charge neutralization section, similar in form to that shown in FIG. 1. A variety of grounded, conductive backing rollers having an outer diameter of 21 cm were employed, having different surface relief patterns. Rollers A1, A2 and A3 each had a groove pitch of 1.6 gpmm, nominal groove width of 125 μm, and groove depth of 64, 112, and 185 μm, respectively. Rollers B1, B2 and B3 each had a groove pitch of 3.2 gpmm, nominal groove width of 64 μm, and groove depth of 74, 117, and 142 μm, respectively.

The coating uniformity was captured digitally and a power spectrum analysis performed. The non-uniformity is expressed as optical density per square root inch. The values tabulated below were measured at the spatial frequency corresponding to the groove pitch of the backing roller used in the web charge neutralization section. Levels above 0.08 were deemed objectionable as groove lines could be discerned in the coating. As shown in Table 2, rollers B1, B2, and B3, having a groove pitch of 3.2 gpmm, did not result in groove lines in the coating even with the use of electrostatic assist. Rollers A1, A2, and A3, having a groove pitch of 1.6 gpmm, while usable without electrostatic assist, produced objectionable groove lines in the coating when 900V of electrostatic assist was applied at the coating backing roller.

TABLE 2

| Roller | Groove Pitch (gpmm) | Groove Depth (μm) | 0 V Assist | 900 V Assist |
|---|---|---|---|---|
| A1 | 1.6 | 64 | .003 | .071 |
| A2 | 1.6 | 112 | .001 | .156 |
| A3 | 1.6 | 185 | .021 | .112 |
| B1 | 3.2 | 74 | .001 | .003 |
| B2 | 3.2 | 117 | .002 | .002 |
| B3 | 3.2 | 142 | .001 | .001 |

EXAMPLE 3

A three-layer coating pack was formed of aqueous gelatin emulsions, the bottom layer containing carbon black to provide optical density. The top layer contained gelatin and a surfactant, exhibited a viscosity of 81 cP and had coating thickness of 6.6 μm. The middle layer contained gelatin, exhibited a viscosity of 60 cP, and had a coating thickness of 48 μm. The bottom layer contained gelatin, surfactant, and carbon black, exhibited a viscosity of 55 cP, and had a coating thickness of 6.6 μm. Curtain coatings were made at 2.0 m/s at a curtain height of 25 cm, application angle of +40° (forward) from top-dead-center, onto a polyester web substrate subbed on both sides with a surface resistivity of about $10^{13}$ ohm per square at relative humidity of 50% and having a thickness of 100 μm. The coating pack was coated using a coating backing roller having a groove pitch of 1 gpmm, groove depth of roughly 100 μm, and a groove width of roughly 500 μm. An electrostatic assist was obtained by controlling the potential of the backing roller to either 0 or 900 volts.

Prior to coating, the charge on the web was neutralized using a web charge neutralization section, similar in form to that shown in FIG. 1. A variety of grounded, conductive backing rollers having an outer diameter of 21 cm were employed, having different surface relief patterns. Rollers A1, A2 and A3 each had a groove pitch of 1.6 gpmm, nominal groove width of 125 μm, and groove depth of 64, 112, and 185 μm, respectively.

The coating uniformity was captured digitally and a power spectrum analysis performed. The non-uniformity is expressed as optical density per square root inch. The values tabulated below were measured at the spatial frequency corresponding to the groove pitch of the backing roller used in the web charge neutralization section. Levels above 0.08 were deemed objectionable as groove lines could be discerned in the coating. As shown in Table 3, rollers A1, A2, and A3, having a groove pitch of 1.6 gpmm, did not result in groove lines in the coating even with the use of electrostatic assist.

TABLE 3

| Roller | Groove Pitch (gpmm) | Groove Depth (μm) | 0 V Assist | 900 V Assist |
|---|---|---|---|---|
| A1 | 1.6 | 64 | .013 | .001 |
| A2 | 1.6 | 112 | .022 | .01 |
| A3 | 1.6 | 185 | .022 | .01 |

The invention has been described in detail with particular reference to certain preferred embodiments thereof, but it will be understood that variations and modifications can be effected within the spirit and scope of the invention.

| PARTS LIST | |
|---|---|
| 10 | coating apparatus |
| 12 | charge neutralization section |
| 14 | coating station |
| 16 | continuous web |
| 17 | transport rollers |
| 18 | first surface |
| 20 | second surface |
| 22 | backing roller |
| 23 | conductive surface |
| 24 | electrodes |
| 26 | electrodes |
| 28 | DC source |
| 30 | electrodes |
| 32 | electrodes |
| 33 | DC source |
| 34 | ionizers |
| 36 | ionizers |
| 38 | power supply |
| 40 | power supply |
| 42 | conductive plate |
| 44 | high-voltage source |
| 46 | control system |
| 48 | sensor array |
| 50 | electronic controller |
| 52 | grounded roller |
| 53 | induction probe |
| 56 | controller |
| 57 | surface |
| 59 | pattern |
| 61 | plateau-like surfaces |
| 63 | chambers and troughs |
| 65 | circumferential grooves |
| 67 | circumferential ridges |

What is claimed is:

1. A method for coating a liquid composition from an applicator to a first surface of a moving web having opposite first and second surfaces, the web being conveyed along a path through a coating apparatus, the coating apparatus including a charge neutralization station for neutralizing stray charges on the web, the charge neutralization station including a backing roller and means for depositing a charge on the web, comprising the steps of:

a) wrapping the web in a partial wrap around the backing roller, the backing roller being provided with a conductive, relieved surface, the relieved surface having a pattern of circumferential grooves that provides venting of entrained air, the pattern having a geometry and depth of greater than 50 um such that any charge left on the web does not disturb the coating applied by the coating apparatus;

b) providing a source of electrostatic charge at the charge neutralization station to neutralize any charge on the web; and c) transporting the charge neutralized web to a coating station, where a liquid composition is applied to the first surface, whereby the coating of liquid composition is not disturbed by stray electrostatic charges.

2. The method claimed in claim 1, wherein the coating method is selected from the group of bead coating, curtain coating, and slide hopper extrusion coating.

3. The method claimed in claim 2, wherein the pattern of circumferential grooves includes at least 1.6 grooves per mm.

4. The method claimed in claim 3, wherein the web transport speed is greater than 2 meters per second.

5. The method claimed in claim 1, wherein the width of the relieved surface on the backing roller is equal to or greater than the width of the liquid coating to be applied to the web.

6. Apparatus for coating a liquid composition from an applicator to a first surface of a moving web having opposite first and second surfaces, the web being conveyed along a path through the coating apparatus, comprising:

a) a charge neutralization station for neutralizing stray charges on the web, the charge neutralization station including i) a backing roller having a conductive, relieved surface having a pattern of circumferential grooves that provides venting of entrained air, the pattern having a geometry and depth of greater than 50 um such that any charge left on the web by the charge neutralization station does not disturb the coating applied by the coating apparatus, and ii) a source of electrostatic charge; and b) a coating station, where a liquid composition is applied to the first surface of the web, whereby the coating of liquid composition is not disturbed by stray electrostatic charges.

7. The apparatus claimed in claim 6, wherein the coating apparatus is selected from the group of bead coating, curtain coating, and slide hopper extrusion coating apparatus.

8. The apparatus claimed in claim 7, wherein the pattern of circumferential grooves includes at least 1.6 grooves per mm.

9. The apparatus claimed in claim 8, wherein the web is conveyed along the path at a speed greater than 2 meters per second.

10. The apparatus claimed in claim 6, wherein the width of the relieved surface on the backing roller is equal to or greater than the width of the liquid coating to be applied to the web.

* * * * *